US011649713B2

(12) United States Patent
Hudson et al.

(10) Patent No.: US 11,649,713 B2
(45) Date of Patent: May 16, 2023

(54) ROPE TENSIONING SYSTEM FOR DRILLING RIG

(71) Applicant: Caterpillar Global Mining Equipment LLC, Denison, TX (US)

(72) Inventors: Charles T. Hudson, Sherman, TX (US); Elangovan Umapathy, Chennai (IN); Prasana R., Chennai (IN)

(73) Assignee: Caterpillar Global Mining Equipment LLC, Denison, TX (US)

( * ) Notice: Subject to any disclaimer, the term of this patent is extended or adjusted under 35 U.S.C. 154(b) by 0 days.

(21) Appl. No.: 17/502,912

(22) Filed: Oct. 15, 2021

(65) Prior Publication Data

US 2023/0124372 A1 Apr. 20, 2023

(51) Int. Cl.

| | |
|---|---|
| ***E21B 44/06*** | (2006.01) |
| ***E21B 7/02*** | (2006.01) |
| ***E21B 19/20*** | (2006.01) |
| ***E21B 19/086*** | (2006.01) |
| ***E21B 19/084*** | (2006.01) |

(52) U.S. Cl.

CPC ..... *E21B 44/06* (2013.01); *E21B 7/022* (2013.01); *E21B 19/084* (2013.01); *E21B 19/086* (2013.01); *E21B 19/20* (2013.01)

(58) Field of Classification Search

CPC ..... E21B 7/022; E21B 19/08; E21B 19/084; E21B 19/086

See application file for complete search history.

(56) References Cited

U.S. PATENT DOCUMENTS

| | | | | |
|---|---|---|---|---|
| 3,867,989 | A | 2/1975 | Hisey et al. | |
| 4,434,860 | A | 3/1984 | Deyo | |
| 8,267,202 | B2 | 9/2012 | Connell | |
| 8,770,272 | B2 | 7/2014 | Harrell | |
| 10,683,712 | B2 | 6/2020 | Demick et al. | |
| 2013/0175045 | A1* | 7/2013 | Rytlewski | E21B 34/045 60/327 |
| 2013/0343928 | A1* | 12/2013 | McCarthy | E21B 43/126 417/379 |
| 2019/0218902 | A1* | 7/2019 | Demick | G01B 21/06 |

FOREIGN PATENT DOCUMENTS

| | | |
|---|---|---|
| CN | 205956325 U | 2/2017 |

* cited by examiner

*Primary Examiner* — Kristyn A Hall

(74) *Attorney, Agent, or Firm* — Leydig, Volt & Mayer, LTD.

(57) ABSTRACT

A rotary drilling rig includes a vertical mast and a rotary head that can vertically move along the mast with respect to a work surface. To move the rotary head along the mast, a hydraulic feed actuator is connected with the rotary head via a wire rope feed system including a hoist rope and a pulldown rope. To maintain the hoist and pulldown ropes in tension and prevent them from dislodging from the respective pulleys of the wire rope system, the hoist and pulldown ropes can be connected to respective hoist and pulldown tensioning actuators. The hoist actuator can be associated with a hoist hydraulic circuit and the pulldown tensioning actuator can be associated with a separate pulldown hydraulic circuit.

21 Claims, 4 Drawing Sheets

ROPE TENSIONING SYSTEM FOR DRILLING RIG

TECHNICAL FIELD

This patent disclosure relates generally to drilling rigs for drilling a hole into the earth and, more particularly, relates to a wire rope system that can move a rotary head with respect to a mast of the drilling rig.

BACKGROUND

Drilling rigs are integrated systems used to drill holes into the ground of the earth. Drilling rigs are commonly used in the petroleum and gas industry, but may also be used for developing water wells, mineral excavation, and other uses. Drilling rigs typically include a mast that can be positioned vertically with respect to the surface of the ground to be drilled and a rotary head that can be vertically moved along the mast. The rotary head includes a driver that can rotate with respect to the rotary head body. The driver may be coupled to a drill string that is an elongated column or drill pipe of multiple string segments that are attached at the distal end to a drill bit. When the driver is rotated, it transmits torque through the drill string to the drill bit that cuts into the surface and subsurface of the earth.

To vertically move the rotary head with respect to the mast, the drilling rig includes a wire rope feed system formed of wire ropes that may be hydraulically actuated to pull down (move vertically downward) and hoist (move vertically upwards) the rotary head. In operation, the rotary head is pulled down over the length of the mast, decoupled from the drill string, and hoisted back up the length of the mast. Once hoisted, another string segment is coupled between the rotary head and the rest of the drill string. The rotary head is then pulled down again thereby feeding the drill string into the ground.

During use the wire ropes may wear and stretch. To maintain tension on the wire ropes, the drilling rig may include one or more hydraulic tensioning actuators that are coupled to the wire ropes of the wire rope feed system. The tensioning actuators reduce or eliminate slack in the wire rope feed system and facilitate operation of the drilling rig. An example of hydraulic tensioning actuators is described in U.S. Pat. No. 10,683,712 (the '712 patent) in which a first tensioning device or actuator is disposed at the top or crown of the mast and a second tensioning device or actuator is secured to the base of the mast. The first and second tensioning devices are operatively coupled to the wire rope system in conjunction with a series of pulleys to maintain tension on the wire ropes. The '712 patent describes a method of monitoring the elongation or stretch of the wire ropes during operation of the drilling rig. The present application is related to a system and method of compensating for elongation and stretch of the wire ropes during pulldown and/or hoist actions.

SUMMARY

The disclosure describes, in one aspect, a mobile rotary drilling rig for forming a hole in the earth. The drilling rig includes a rig frame supported on a plurality of propulsion devices for propelling the mobile rotary drilling rig over a work surface. A mast is mounted to the rig frame and can stand vertically erect over the work surface. Movably supported along the mast can be a rotary head that is coupled to and adapted to rotate a drilling string with respect to the work surface. To move the rotary head, a hydraulic feed actuator can be movably guide along the mast. A wire rope feed system connects the rotary head with the hydraulic feed actuator. The wire rope feed system includes a hoist wire rope connected at a first hoist rope end to a hoist tensioning actuator disposed on the mast and connected at a second hoist rope end to the rotary head and a pulldown wire rope connected at a first pulldown rope end to a pulldown tensioning actuator and connected at a second pulldown rope end to the rotary head. To maintain the hoist and pulldown wire ropes in tension, the wire rope feed system can be associated with a tensioning hydraulic circuit configured to direct hydraulic fluid at a tensioning pressure to the hoist tensioning actuator and to the pulldown tensioning actuator. The tensioning hydraulic circuit including a hoist hydraulic circuit operatively associated with the hoist tensioning actuator and having a pressure relief valve in fluid communication with the hoist tensioning actuator to relieve hydraulic pressure therein.

In another aspect, there is disclosed a method of tensioning a wire rope feed system for a drilling rig. The method involves directing hydraulic fluid at a tensioning pressure to a hoist tensioning actuator connected to a first hoist rope end of a hoist wire rope that has a second hoist rope end connected to a rotary head of the drilling system. The method further involves directing hydraulic fluid at the tensioning pressure to a pulldown tensioning actuator connected to a first pulldown rope end of a pulldown wire rope that has a second pulldown rope end connected to the rotary head of the drilling system. A pulldown operation is commenced by moving the rotary head toward a work surface with the pulldown wire rope resulting in stretching of the pulldown wire rope and slackening of the hoist wire rope. To reduce slack in the hoist wire rope, the hoist tensioning actuator connected to the first hoist rope end of the hoist wire rope is retracted. If the pulldown operation is ceased, the hydraulic pressure in the hoist tensioning actuator may exceed a relief pressure threshold. To relieve the hydraulic pressure in the hoist tensioning actuator a pressure relief valve in fluid communication with the hoist tensioning actuator may be opened directing hydraulic fluid to a hydraulic reservoir.

In a further aspect, the disclosure describes a rotary drilling rig including a rig frame and a mast mounted to the rig frame. A rotary head is movably supported along the mast and coupled with a rotatable drilling string. To move the rotary head vertically along the mast, a hydraulic feed actuator is coupled to the mast and a wire rope feed system connects the rotary head with the hydraulic feed actuator. The rope feed system includes a hoist wire rope connected at a first hoist rope end to a hoist tensioning actuator disposed on the mast and connected at a second hoist rope end to the rotary head. The wire rope system also includes a pulldown wire rope connected at a first pulldown rope end to a pulldown tensioning actuator and connected at a second pulldown rope end to the rotary head. To maintain tension on the hoist and pulldown wire ropes, a tensioning hydraulic circuit is configured to direct hydraulic fluid to the hoist tensioning actuator and to the pulldown tensioning actuator. The tensioning hydraulic circuit includes a hoist hydraulic circuit operatively associated with the hoist tensioning actuator and having a pressure relief feature configured to relieve hydraulic pressure in the hoist tensioning actuator in excess of a relief pressure threshold. The tensioning hydraulic circuit also includes a pulldown hydraulic circuit having a pressure isolation feature configured to isolate hydraulic pressure in the pulldown tensioning actuator.

DETAILED DESCRIPTION

Figure 1:
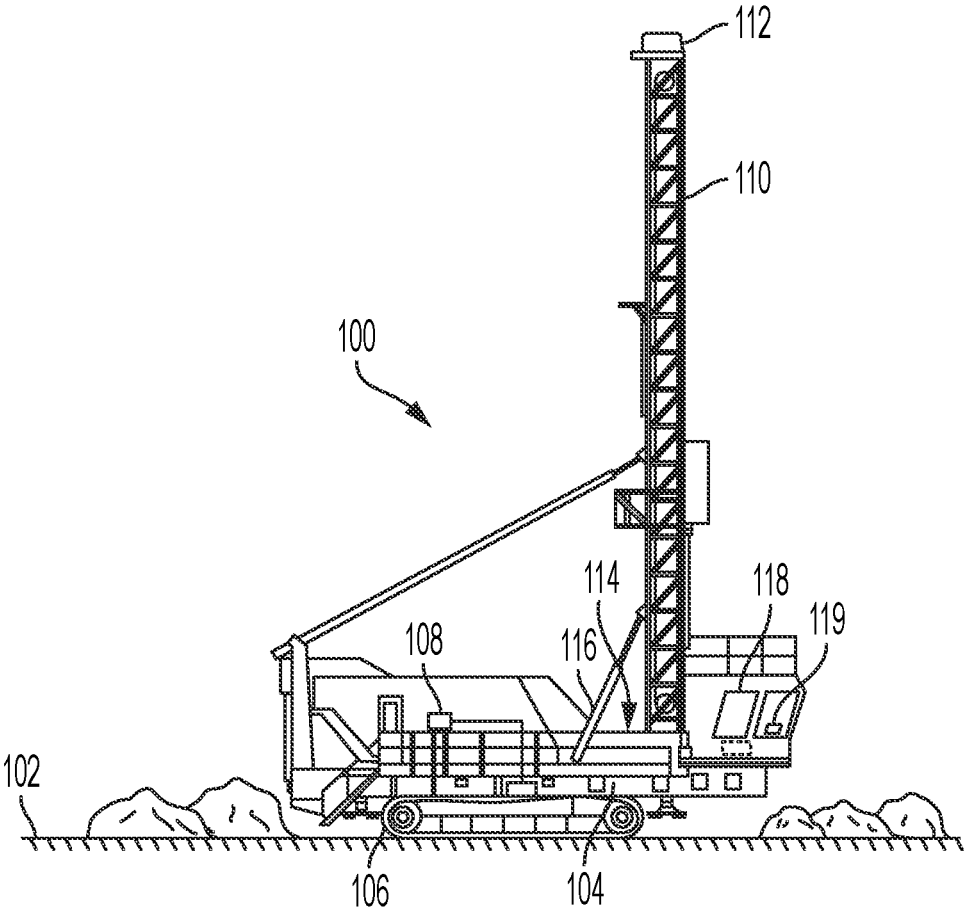
FIG. 1 is a schematic illustration of a mobile rotary drilling rig for forming a hole by feeding a drill string into the earth.

Now referring to the figures, wherein whenever possible like reference numbers refer to like elements, there is illustrated a mobile drilling rig 100 that can form holes in the work surface 102 and the underlying subsurface of the earth for oil and gas extraction, mineral procurement, well formation, and other uses. One particular drilling operation is blast hole drilling in which explosives are packed into the hole formed by the drilling rig 100 and are detonated with the resulting explosion fracturing the underlying rock of the subsurface of the work surface 102.

While the illustrated embodiment of the drilling rig 100 is mobile and can move with respect to the work surface 102, the present disclosure is also applicable to fixed drilling rigs, offshore drilling rigs or platforms, and other configurations. The drilling rig 100 includes a rig frame 104 that is supported on a plurality of propulsion devices 106 that contact the work surface 102. The propulsion devices 106 may be continuous tracks or crawler tracks that can translate with respect to the rig frame 104 thereby moving the drilling rig over the work surface 102. In other embodiments, the propulsion devices 106 can be wheels or, as stated above, the drilling rig 100 may be fixed with respect to the work surface 102 or it may be marine based and operate offshore. To power the propulsion devices 106 and other systems of the drilling rig 100, a motor 108 is disposed on the rig frame 104. The motor 108 may be an internal combustion engine that combusts hydrocarbon-based fuels and converts the energy therein to a motive force. In other embodiments, the motor 108 may be operatively connected to an external source of electrical power and receive electric current to power operation of the drilling rig 100.

The drilling rig 100 can include a mast 110 that is an erect structure that can be vertically positioned with respect to the work surface 102. The mast 110 is an elongated structure that extends between a top or crown 112 that is vertically elevated above the rig frame 104 and a base 114 that is located proximate to the work surface 102. The mast 110 can be assembled as a truss made from a plurality of metal beams and bars interconnected together to form a rigid structure capable of standing upright in the vertically elevated position. In an embodiment, the mast 110 can be pivotally coupled to the rig frame 104 so that the mast 110 can be raised and lowered between the vertical and non-vertical positions via a lift cylinder 116. When the mast 110 is in the raised position, the drilling rig 100 is configured for a drilling operation and when the mast is lowered, the drilling rig 100 is configured for a traveling operation. Additionally, in the embodiments where the mast 110 is pivotally coupled to the rig frame 104, the mast may be oriented at an angle with respect to the work surface 102 so that a hole can be formed angularly into the earth.

To accommodate one or more human operators for conducting drilling operations, an onboard operator station 118 may be accommodated on the rig frame 104. Located within the operator station 118 can be various operator control devices 119 such as levers, pedals, wheels, displays, and the like. In the illustrated embodiment, the operator station 118 can be an enclosed space but in other embodiments, the operator station may be located exteriorly. Furthermore, in possible embodiments, the drilling rig 100 can be configured for remote operation with the operator station 118 and the operator control devices 119 located off board of and remote from the drilling rig 100.

Figure 2:
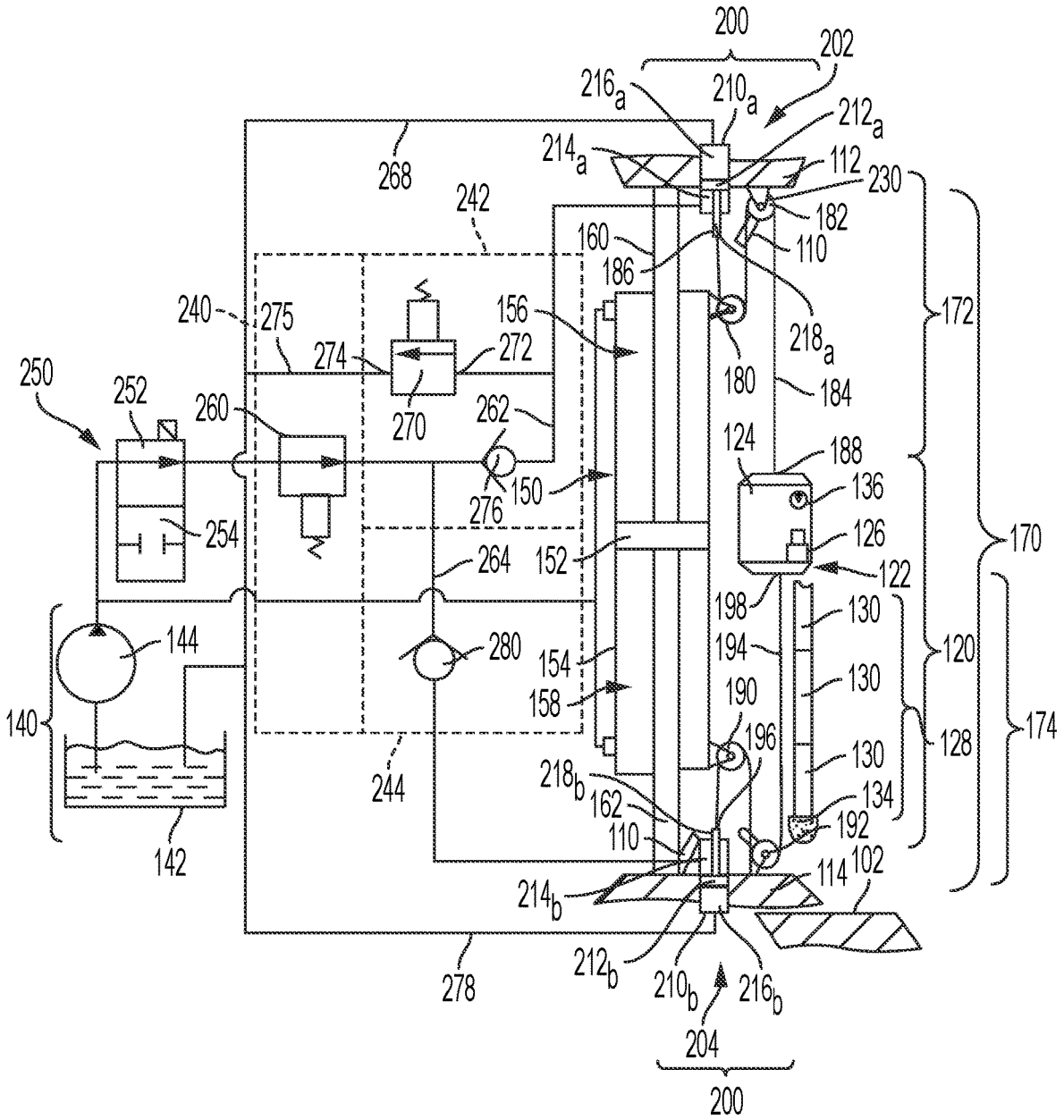
FIG. 2 is a schematic illustration of the wire rope feed system that can vertically pulldown and hoist a rotary head coupled to the drill string with respect to the mast, the wire rope feed system including a tensioning hydraulic circuit to maintain tension on the hoist and/or pulldown wire rope of the wire rope feed system.

Referring to FIG. 2, there is illustrated the components of the drilling system 120 of the drilling rig 100. The drilling system 120 includes a rotary head 122 that is guided by and movable along the mast 110 during pulldown and hoist actions. The rotary head 122 includes a body 124 that is operatively connected to the mast 110, for example, by guide tracks, and a driver 126 that rotates within the body 124. The driver 126 can be coupled to an elongated drill string 128 that is formed of a plurality of string sections 130. The string sections 130 are straight pipe-like structures that can be coupled together to adjust the length of the drill string 128. The string sections 130 may be solid for rigidity or may be hollow and adapted to convey drilling fluid into the hole or bore formed during the drilling operation. Attached at the distal end of the drill string 128 can be a drill bit 134 that is structurally configured to penetrate into the work surface 102 and the subsurface underneath. To rotate the drill string 128, the rotary head 122 can include one or more hydraulic motors 136 that are operatively associated with a hydraulic system 140 of the drilling rig. The hydraulic system 140 may include a hydraulic reservoir 142 and hydraulic pump 144 as described below. The hydraulic motor 136 can receive pressurized hydraulic fluid from the hydraulic system 140 and rotate the driver 126 with respect to the body 124 of the rotary head 122.

To move the rotary head 122 with respect to the mast 110, the drilling system 120 includes a hydraulic feed actuator 150 that includes a disc-shaped feed piston 152 disposed within a tubular feed cylinder 154. The feed piston 152 can separate the feed cylinder 154 into an upper chamber 156 and a lower chamber 158. The hydraulic feed actuator 150 can be fluidly coupled to the hydraulic system 140 of the drilling rig 100 to receive pressurized hydraulic fluid to either the upper chamber 156 or the lower chamber 158 of the feed cylinder 154. The feed piston 152 can be fixedly connected with the mast 110 so that when hydraulic fluid is introduced, for example, into the upper chamber 156, the feed cylinder 154 is forcibly moved upwards with respect to the mast 110. Similarly, when hydraulic fluid is introduced into the lower chamber 158, the feed cylinder 154 is forcibly move downwards with respect to the mast 110.

In the illustrated embodiment, to fix the feed piston 152 to the mast 110 and enable vertical motion of the feed cylinder 154, the feed actuator 150 can include a first feed piston rod 160 joined to the feed piston 152 that extends axially upwards through the upper chamber 156 of the hollow feed cylinder 154 and can be fixedly connected proximate to the crown 112 of the mast 110. Likewise, a second feed piston rod 162 joined to the feed piston 152 can extend axially downwards through the lower chamber 158 of the hollow feed cylinder 154 and can be fixedly connected proximate to the base 114 of the mast 110. Accordingly, the relative vertical position of the feed piston 152 with respect to the mast 110 is rigidly fixed. The feed cylinder 154 therefore acts as a free body such that introduction of hydraulic fluid into either the upper chamber 156 or the lower chamber 158 of the hydraulic feed actuator 150 results in vertical movement of the feed cylinder 154 generally between the mast crown 112 and the mast base 114. In another embodiment, the feed cylinder 154 may be fixed with respect to the mast 110 and the feed piston 152 and the first and second feed pistons rods 160, 162 may move with respect to the mast. In other possible embodiments, the feed actuator 150 can have other configurations enabling relative vertical movement with respect to the mast 110 and may utilize actuating technologies other than or in addition to hydraulics such as, for example, a mechanical ball screw, linear electrical motors, or the like.

To translate vertical movement of the feed actuator 150 with respect to the mast 110 to relative movement of the rotary head 122, the drilling system 120 can include a wire rope feed system 170 including a plurality of wire ropes that can operatively connect the feed actuator 150 to the body 124 of the rotatory head 122. The wire ropes can be formed as steel wire ropes assembled from many individual strands of thinner metal wires wound or braided together to form a flexible, elongated, and larger diameter wire rope. The flexible steel wire rope can be used as the running rigging of the wire rope feed system 170 and are adapted to bend around and extend about sheaves and pulleys. Depending on the drilling operation, the wire rope feed system 170 can be further differentiated into a hoist rope system 172 responsible for hoisting the rotary head 122 and a pulldown rope system 174 responsible for pulling down the rotary head 122 with respect to the work surface 102. It should be appreciated however that the hoist rope system 172 and the pulldown rope system 174 operate in cooperation to perform their respective operations.

The hoist rope system 172 can encompass the upper components of the wire rope feed system 170 and can include a cylinder hoist pulley 180 that may be exteriorly mounted, for example, to the upper end of the feed cylinder 154 such that the cylinder hoist pulley 180 can vertically move in unison with the feed cylinder 154. The hoist rope system 172 can also include a mast hoist pulley 182 fixedly mounted to the crown 112 of the mast 110 and is thus suspended vertically high above the work surface 102. Directed around and operatively linking the cylinder hoist pulley 180 and the mast hoist pulley 182 can be a fixed length of flexible hoist wire rope 184 as described above. The hoist wire rope 184 can extend between a first hoist rope end 186 proximately connected with the crown 112 of the mast 110 and a second hoist rope end 188 fixedly connected to the exterior upper end of the body 124 of the rotary head 122. To enable the hoist wire rope 184 to run between and extend around the cylinder hoist pulley 180 and the mast hoist pulley 182, those components can each include a rotating sheave supported by a pulley frame and which is formed as a grooved wheel that holds and guides the hoist wire rope.

The pulldown rope system 174 can encompass the lower components of the wire rope feed system 170 and can include a cylinder pulldown pulley 190 that may be exteriorly mounted, for example, to the lower end of the feed cylinder 154 such that the cylinder pulldown pulley 190 can vertically move in unison with the feed cylinder 154. The pulldown rope system 174 can also include a mast pulldown pulley 192 fixedly mounted to the base 114 of the mast 110 and is thus generally located proximate to the work surface 102. Directed around and operatively linking the cylinder pulldown pulley 190 and the mast pulldown pulley 192 can be a fixed length of flexible pulldown wire rope 194 as described above. The pulldown wire rope 194 can extend between a first pulldown rope end 196 proximately connected with the base 114 of the mast 110 and a second pulldown rope end 198 fixedly connected to the exterior lower end of the body 124 of the rotary head 122. To enable the pulldown wire rope 194 to run between and extend around the cylinder pulldown pulley 190 and the mast pulldown pulley 192, those components can each include a rotating sheave supported by a pulley frame and which is formed as a grooved wheel that holds and guides the pulldown wire rope.

The pulleys and wire rope of the hoist rope system 172 and the pulleys and wire rope of the pulldown rope system 174 form block and tackle systems for vertically hoisting and pulling down the rotary head 122. For example, during a hoist operation, pressurized hydraulic fluid is directed into the lower chamber 158 of the feed actuator 150, causing the feed cylinder 154 acting as a free body to move vertically downwards with respect to the mast 110. The cylinder hoist pulley 180 likewise moves vertically downwards with the feed cylinder 154 and thus moves vertically apart from the mast hoist pulley 182. To accommodate the increasing vertical distance between the cylinder hoist pulley 180 and mast hoist pulley 182, and likewise the increasing vertical distance between the cylinder hoist pulley 180 and the crown 112 of the mast 110, the length of the hoist wire rope 184 between those elements must be increased. Because the hoist wire rope 184 has a fixed length between the first rope end 186 connected to the mast crown 112 and the second hoist rope end 188 connected to the body 124 of the rotary head 122, the increase in the length of the hoist wire rope 184 between the cylinder hoist pulley 180 and mast hoist pulley 182 is accompanied by a corresponding decrease in length of the hoist wire rope 184 between the mast hoist pulley 182 and the rotary head 122. The result is that the rotary head 122 is pulled vertically upwards with respect to the mast 110 and towards the crown 112. It will be appreciated that pulldown rope system 174 must function in an opposite manner to increase the length of the pulldown wire rope 194 extending between the mast pulldown pulley 192 and the body 124 of the rotary head 122 to allow the rotary head to vertically rise with respect to the mast 110.

Correspondingly, during a pulldown operation, pressurized hydraulic fluid is directed into the upper chamber 156 of the feed actuator 150, causing the feed cylinder 154 acting as free body to move vertically upwards with respect to the mast 110. The cylinder pulldown pulley 190 likewise moves vertically upwards with the feed cylinder 154 and thus moves vertically apart from the mast pulldown pulley 192. To accommodate the increasing vertical distance between the cylinder pulldown pulley 190 and mast pulldown pulley 192, and likewise the increasing vertical distance between the cylinder pulldown pulley 190 and base 114 of the mast 110, the length of the pulldown wire rope 194 between those elements must be increased. Because of the fixed length of the pulldown wire rope 194, the increase in the length of the pulldown wire rope 194 between the cylinder pulldown pulley 190 and mast pulldown pulley 192 is accompanied by a corresponding decrease in length of the pulldown wire rope between the mast pulldown pulley 192 and the rotary head 122. This results in the rotary head 122 being pulled downwards with respect to the mast 110 and towards the base 114. Downward movement of the rotary head 122 drives the drill string 128 and drill bit 134 into the work surface 102. It will be appreciated that the hoist rope system 172 must cooperatively function to increase the length of the hoist wire rope 184 extending between the mast hoist pulley 182 and the body 124 of the rotary head 122 to allow the rotary head to move vertically downwards.

The hoist wire rope 184 and the pulldown wire rope 194 are placed under significant stress and tension during the respective hoist and pulldown operations. The tension can stretch and cause elongation of the hoist ca wire rope 184 and pulldown wire rope 194 and, because of the substantial lengths of the hoist and pulldown wire ropes, elongation of the wire ropes may be approximately several millimeters or inches. Maintaining the hoist wire rope 184 and the pulldown wire rope 194 in tension may compensate for elongation of the wire rope. However, if tension on the hoist wire rope 184 or the pulldown wire rope 194 is suddenly released, for example, when switching between hoist and pulldown operations or if the drilling system 120 were to encounter a hard rock formation during a pulldown operation, the wire ropes may become slack as result of the previous stretching and elongation. Slack in the hoist wire rope 184 and the pulldown wire rope 194 may allow the wire ropes to dislodge or come off of the pulleys and the freed wire ropes may swing about and cause damage to the surrounding components of the drilling system 120.

Therefore, to maintain tension on the hoist wire rope 184 and the pulldown wire rope 194, the drilling system 120 may be associated with tensioning system 200 including a hoist tensioning actuator 202 and a pulldown tensioning actuator 204. The hoist and pulldown tensioning actuators 202, 204 may be embodied as double acting cylinders or as a spring loaded single acting cylindrical responsive to the receipt and discharge of hydraulic fluid therein. The hoist and pulldown tensioning actuators 202, 204 each may be embodied as a single rod hydraulic cylinder including a hollow, tubular hydraulic cylinder body 210*a*, 210*b* with a hydraulic piston 212*a*, 212*b* disposed therein. The hydraulic piston 212*a*, 212*b* can separate the hydraulic cylinder body 210*a*, 212*b* into a first hydraulic chamber, referred to as the rod end chamber 214*a*, 214*b* and a second hydraulic chamber, referred to as the piston end chamber 216*a*, 214*b*. To connect with the terminal end of a respective wire rope, a hydraulic piston rod 218*a*, 218*b* joined to the hydraulic piston 212*a*, 212*b* extends through the rod end chamber 214*a*, 214*b* and protrudes exteriorly of the hydraulic cylinder body 210*a*, 210B. To receive and discharge hydraulic fluid, the hoist tensioning actuator 202 and a pulldown tensioning actuator 204 may be operatively associated with the hydraulic system 140 of the drilling rig or may be supplied by a separate source of hydraulic fluid.

In an embodiment, the hoist tensioning actuator 202 can be fixedly disposed within the crown 112 of the mast and can be arranged so that the hydraulic piston rod 218*a* extends vertically downwards and can be connected with the first hoist rope end 186 of the hoist wire rope 184. Likewise, in an embodiment, the pulldown tensioning actuator 204 can be fixedly disposed within the base 114 of the mast 110 and can be arranged so that the hydraulic piston rod 218*b* extends vertically upwards and connects with the first pulldown rope end 196 of the pulldown wire rope 194. Directing pressurized hydraulic fluid to the rod end chamber 214*a*, 214*b* linearly moves the hydraulic piston 212*a*, 212*b* to retract the hydraulic piston rod 218*a*, 218*b* into the hydraulic cylinder body 210*a*, 210*b*. Retraction of the hydraulic piston rod 218*a*, 218*b* maintains the respective hoist wire rope 184 or the pulldown wire rope 194 in tension, reducing wire rope slack and preventing the wire ropes from dislodging from the pulleys. Because the hydraulic piston 212*a*, 212*b* can move linearly in either axial direction in the hydraulic cylinder body 210*a*, 210*b*, the hoist and pulldown tensioning actuators 202, 204 can accommodate temporary variations of the stresses applied to the hoist wire rope 184 and the pulldown wire rope 194.

In other embodiments, the hoist and pulldown tensioning actuators 202, 204 may be positioned at other locations and in other orientations suitable for maintaining appropriate tension on the hoist and pulldown wire ropes 184, 194. For example, the hoist and pulldown tensioning actuators 202, 204 may be located on and fixed to the feed cylinder 144 of the hydraulic feed actuator 140 and can be operatively connected to the cylinder hoist pulley 180 and cylinder pulldown pulley 190, respectively, to interact with the hoist wire rope 184 and the pulldown wire rope 194 passing there around. For example, the first rope ends 186, 196 of the hoist and pulldown wire ropes 184, 194 may be fixed to the crown 112 and base 114 of the mast 110 while the length of the hoist and pulldown wire ropes passes around the respective cylinder hoist pulley 180 and cylinder pulldown pulley 190. Extension and retraction of the hydraulic piston rod 218*a*, 218*b*, which may be connected to the cylinder hoist pulley 180 and/or cylinder pulldown pulley 190, thereby enables the hoist and pulldown tension actuators 202, 204 to displace the hoist and pulldown wire ropes 184, 194 and thereby vertically move the rotary head 122 attached to the second hoist rope end 188 and/or second pulldown rope end 198.

In an embodiment, to determine the depth of the hole being formed by the drilling system 120, a rotary sensor 230 such as a rotary encoder can be operatively associated with the wire rope feed system 170. For example, the rotary sensor 230 can be disposed proximate to the crown 112 of the mast 110 and configured to measure the rotations made by the mast hoist pulley 182. By counting the number of rotations made by the sheave of the mast hoist pulley 182, and if its diameter is known, the cumulative run or payout of the hoist wire rope 184 between the mast host pulley 128 and the rotary head 122 over the course of the pulldown operation can be calculated. That calculation also determines how far the drill string 128 has penetrated into the work surface 102 and thus the depth of the hole or bore being formed. A related advantage of the hoist tensioning actuator 202 in reducing slack in the hoist wire rope 184 is that it prevents slipping of the hoist wire rope with respect to the mast host pulley 182 and improves accuracy in estimating the cumulative length of rope paid out during a pulldown operation and thus the depth of the hole.

In the embodiment where a hoist tensioning actuator 202 and the pulldown tensioning actuator 204 receive hydraulic fluid of the same hydraulic pressure in equal quantities from the same drill system hydraulic circuit 140, the hoist and pulldown tensioning actuators can maintain the same tension on the respective hoist and pulldown wire ropes 184, 194. This may be referred to as nominal tension. However, maintaining the hoist and pulldown wire ropes 184, 194 under consistent nominal tension at all times may be disadvantageous. For example, maintaining the pulldown wire rope 194 under nominal tension regardless of the actual hoist forces being applied to the wire ropes may result in excessive nominal tension once the hoisting force subsides, which may negatively impact the wire rope life. Further, the hoist and pulldown forces applied to the hoist wire rope 184 may not be the same as applied to the pulldown wire rope 194 for example, once the drilling system 120 penetrates the work surface 102 and counter forces are directed through the drill string 128.

Accordingly, to accommodate changes to operation of the drilling system 120, a tensioning hydraulic circuit 240 can be operatively associated with the tensioning system 200. Further, to enable the hoist tensioning system and the pulldown tensioning system to independently respond to changes in the drilling operation, the tensioning hydraulic circuit 240 can be operatively separated into a hoist hydraulic circuit 242 and a pulldown hydraulic circuit 244. Referring to FIG. 2, there is illustrated an embodiment of a possible arrangement for the tensioning hydraulic circuit 240 including the hoist hydraulic circuit 242 and a pulldown hydraulic circuit 244. The tensioning hydraulic circuit 240, hoist hydraulic circuit 242, and a pulldown hydraulic circuit 244 are generally indicated by dashed lines.

To supply the hydraulic fluid that actuates the hoist and pulldown tensioning actuators 202, 204, the tensioning hydraulic circuit 240 can be operatively associated with the hydraulic circuit 140 and in fluid communication with the hydraulic reservoir 142 and hydraulic pump 144. The hydraulic reservoir 142 contains a volume of relatively low pressure hydraulic fluid and may be vented to the atmosphere or may be enclosed so that the hydraulic fluid is maintained in a slightly pressurized state. The hydraulic fluid can be any suitable type of incompressible fluid such as lubrication oil or the like and may have a sufficient viscosity to enable the fluid to readily flow in the hydraulic system. In an embodiment, the hydraulic reservoir 142 may function as a sump to which the tensioning hydraulic circuit 240 returns and hydraulic fluid can collect.

To pressurize and direct hydraulic fluid from the hydraulic reservoir 142 to the tensioning hydraulic circuit 240, a hydraulic pump 144 can be included and in fluid communication with hydraulic reservoir 142. The tensioning hydraulic circuit 240 thus receives hydraulic fluid at the hydraulic pressure established by the hydraulic motor 144.

To change the tensioning hydraulic circuit 240 between an active state and an inactive state, a control valve 250 can be disposed downstream of and in fluid communication with the hydraulic pump 144. The control valve 250 can be a two positioned one-way directional control valve including an opened position 252 in which hydraulic fluid is readily directed to the tensioning hydraulic circuit 240 and a closed position 254 which prevents hydraulic fluid from flowing to the tensioning hydraulic circuit 240, however, in other embodiments the control valve 250 may have other configurations. In addition, the control valve 250 may be actuated electrically, hydraulically, or mechanically. When the control valve 250 is in the opened position 252, the tensioning hydraulic circuit 240 is in the active state and the hoisting tensioning actuator 202 and the pulldown tensioning actuator 204 are able to receive pressurized hydraulic fluid. When the control valve 250 is in the closed position 254, the tensioning hydraulic circuit 240 is in the inactive state and no hydraulic fluid can no longer flow to the tensioning hydraulic circuit 240.

In an embodiment, to control or reduce the hydraulic pressure of the inflowing hydraulic fluid, the tensioning hydraulic circuit 240 can include a pressure reducing valve 260. The pressure reducing valve 260 can be a spring biased valve that is normally opened but that can throttle or reduce the flow there through to lower the pressure of the hydraulic fluid from system pressure to a hydraulic pressure suitable for regulating operation of the tensioning system 200. In various embodiments, the pressure reducing valve 260 may be actuated electrically, hydraulically, or mechanically. The hydraulic pressure of the hydraulic fluid established by the pressure reducing valve 260 may be referred to as the tensioning pressure of the tensioning hydraulic system 240. In other embodiments, the tensioning pressure may be established by other pressure control devices such as variable control pumps, restrictors, and the like.

The pressure reducing valve 260 can be in fluid communication with and deliver pressurized hydraulic fluid to both the hoist hydraulic circuit 242 and the pulldown hydraulic circuit 244. To direct hydraulic fluid to the rod end chamber 214*a* of the hoist tensioning actuator 202, the hoist hydraulic circuit 242 can include a hoist actuator supply conduit 262 downstream of and in fluid communication with the pressure reducing valve 260. Similarly, to supply hydraulic fluid at the tensioning pressure to the rod end chamber 214*b* of the pulldown tensioning actuator 204, the pulldown hydraulic circuit 244 can include a pull actuator supply conduit 264 downstream of and in fluid communication with the pressure reducing valve 260. As stated above, the hoist actuator supply conduit 262 and the pulldown actuator supply conduit 264 can have any suitable construction for channeling fluid such as flexible hoses, tubing, pipes and the like.

Because the hoist actuator supply conduit 262 establishes fluid communication between the pressure reducing valve 260 and the rod end chamber 214*a* of the hoist tensioning actuator 202, the rod end chamber 214*a* is maintained at the tensioning pressure established by the pressure reducing valve 260 that attempts to linearly retract the hydraulic piston rod 218*a* into the hydraulic cylinder body 210*a*. More specifically, the tensioning pressure attempts to displace the hydraulic piston 212*a* toward the piston end chamber 216*a* and increase the volume of the rod end chamber 214*a*. Thus, the tension pressure in the rod end chamber 214*a* that retracts the hydraulic piston rod 218*a* into the hoist tensioning actuator 202 maintains the hoist wire rope 184 under tension in accordance with the tensioning pressure and reduces any slack therein. To maintain the piston end chamber 216*a* of the hoist tensioning actuator 202 at a relatively reduced pressure, and thus facilitate retraction of the hydraulic piston rod 218*a* into the hydraulic cylinder body 210*a*, a hoist actuator return conduit 268 can establish fluid communication between the piston end chamber 216*a* and the hydraulic reservoir 142. In other embodiments, the hoist tensioning actuator 202 may be a spring loaded, single acting cylinder with a spring biasing the hydraulic piston 212*a* and hydraulic piston rod 218*a* toward the rod end chamber 214*a* and the hoist actuator return conduit 268 can be omitted.

To maintain or limit the hydraulic pressure in the rod end chamber 214*a* of the hoist tensioning actuator 202 at a predetermined threshold pressure, which may be referred to as the relief pressure threshold, the hoist hydraulic circuit 242 can include a pressure limiting feature that is configured to relief hydraulic pressure in the hoist tensioning actuator 202. The pressure limiting feature can be configured to direct a portion of the inflowing hydraulic fluid away from the hoist actuator supply conduit 262 and thus away from the hoist tensioning actuator 202. In an embodiment, the pressure limiting feature may be a pressure relief valve 270. A valve inlet 272 of pressure relief valve 270 can be in fluid communication with the hoist actuator supply conduit 262 and a valve outlet 274 of the pressure relief valve 270 can be in fluid communication with the hoist actuator return conduit 268 and thus the hydraulic reservoir 142. The pressure relief valve 270 may be located in a bypass conduit 275 associated with the hoist hydraulic circuit 242 that is fluidly connected between the hoist actuator supply conduit 262 and the hoist actuator return conduit 268. The pressure relief valve 270 can be in a normally closed state so that the rod end chamber 214*a* of the hoist tensioning actuator 202 only receives inflowing hydraulic fluid at the tensioning pressure established by the pressure reducing valve 260.

In the event the hydraulic pressure in the rod end chamber 214 exceeds a predetermined relief pressure threshold, the pressure relief valve 270 partially opens to divert or direct a portion of the hydraulic fluid to the hoist actuator return conduit 268 and thus the hydraulic reservoir 142. The pressure relief valve 270 allows a portion of the hydraulic fluid to bypass or the flow from the hoist tensioning actuator 202 and be directly returned to the hydraulic reservoir 142. The rod end chamber 214*a* of the hoist tensioning actuator 202 is thus maintained at or limited to the relief pressure threshold and the hoist wire rope 184 is maintained in tension in accordance with the relief pressure threshold.

The relief pressure threshold can be set to any suitable pressure for maintaining the hoist wire rope 184 under tension by action of the hoist tensioning actuator. In an embodiment, the relief pressure threshold may be set at the tensioning pressure established by the pressure reducing valve 260. In another embodiment, the relief pressure threshold may be set above the tensioning pressure and may for example be a multiple of the tension pressure. In an embodiment, the relief pressure threshold may fall within a range of one to six times the tension pressure set by the pressure reducing valve 260. For example, if the tensioning pressure established by the pressure reducing valve 260 is 10 bars, the relief pressure threshold may fall within a range of 10 to 60 bars. Accordingly, the hydraulic pressure in the hoist tensioning actuator 202 may rise above the tensioning pressure before the pressure relief valve 270 opens.

In an embodiment, the pressure relief valve 270 can be a spring loaded or solenoid controlled valve and can be actuated mechanically, electrically, or electromechanically. The pressure relief valve 270 may be linearly functioning so that the quantity of inflowing hydraulic fluid diverted to the hoist actuator return line 268 is proportional to the degree by which hydraulic pressure in the rod end chamber 214*a* of the hoist tensioning actuator 202 exceeds the pressure relief threshold. The pressure relief valve 270 can thus quickly react to pressure spikes in the hoist tensioning actuator 202 arising from sudden changes or disruptions in the pulldown or hoisting operations.

In an embodiment, the hoist hydraulic circuit 242 can include a hoist circuit check valve 276 that is disposed in the hoist circuit supply conduit 262 upstream of the pressure relief valve 270 and the bypass conduit 275. The hoist circuit check valve 276 is configured as a one-way flow control valve that allows inflowing hydraulic fluid to flow into the hoist tensioning actuator 202 but prevents hydraulic fluid from flowing back upstream towards the pressure reducing valve 260. The hoist circuit check valve 276 maintains hydraulic pressure downstream in the hoist circuit supply conduit 262 and in the hoist tensioning actuator 202. If the hydraulic pressure in the hoist tensioning actuator 202 exceeds the inflowing pressure, for example, the tensioning pressure established by the pressure reducing valve 260, a portion of the hydraulic fluid in the hoist hydraulic circuit 242 is directed to the pressure relief valve 270 and cannot flow back to the pressure reducing valve 260 or the pulldown actuator supply conduit 264 communicating with the pulldown tensioning actuator 204 due to the hoist circuit check valve 276. The hoist circuit check valve 276 ensures that, in the event hydraulic pressure exceeds the relief pressure threshold, excess hydraulic fluid from the hoist tensioning actuator 202 is directed through the pressure relief valve 270 and cannot flow back upstream in the hoist hydraulic circuit 242. The pressure setting at which the pressure relief valve 270 opens, for example, the relief pressure threshold, is therefore the pressure limit of the hoist hydraulic circuit 202.

The pulldown actuator supply conduit 264 is fluidly connected to the hoist actuator supply conduit 262 between the pressure reducing valve 260 and the hoist circuit check valve 276 to receive inflowing hydraulic fluid at the predetermined hydraulic pressure, for example, the tensioning pressure established by the pressure reducing valve 260. The pulldown actuator supply conduit 264 directs inflowing hydraulic fluid to the rod end chamber 214*b* of the pulldown tensioning actuator 204 so that the rod end chamber is maintained at the tensioning pressure. The tensioning pressure in the rod end chamber 214*b* displaces the hydraulic piston 212*b* towards the piston end chamber 216*b* and retracts the hydraulic piston rod 218*b* into the hydraulic cylinder body 210*b* of the pulldown tensioning actuator 204. Retraction of the hydraulic piston rod 218*b* places the pulldown wire rope 194 to which it is connected under tension in accordance with the tensioning pressure and reduces any slack therein. To maintain the piston end chamber 216*b* of the pulldown tensioning actuator 204 at a relative reduced pressure, and thus facilitate retraction of the hydraulic piston rod 218 into the hydraulic cylinder body 210, a pulldown actuator return conduit 278 can establish fluid communication between the piston end chamber 216*b* and the hydraulic reservoir 142. In other embodiments, the pulldown tensioning actuator 204 may be a spring-loaded, single acting cylinder with a spring biasing the hydraulic piston 212*b* and hydraulic piston rod 218*b* toward the rod end chamber 214*b* and the pulldown actuator return conduit 278 can be omitted.

In an embodiment, the pulldown hydraulic circuit 244 can include a pressure isolation feature that is configured to isolate the hydraulic pressure established in the pulldown tensioning actuator 204. More specifically, the pressure isolation feature may function to isolate or trap hydraulic fluid in the rod end chamber 214*b* of the pulldown tensioning actuator 204 and thus maintains the hydraulic pressure established therein, even if above the tensioning pressure established by the pressure reducing valve 260. In an embodiment, the pressure isolation feature may be a pulldown circuit check valve 280 disposed in the pulldown actuator supply line 264 and located between the fluid connection to the hoist actuator supply conduit 262 and the pulldown tensioning actuator 204. The pulldown circuit check valve 280 is a one-way flow valve that allows inflowing hydraulic fluid to flow into the pulldown tensioning actuator 204 but prevents hydraulic fluid from flowing back upstream toward the pressure reducing valve 260.

The pulldown circuit check valve 280 ensures the pulldown tensioning actuator 204 is maintained at least at the predetermine pressure set by the pressure reducing valve 260, for example, the tensioning pressure. For example, if the rod end chamber 214*b* of the pulldown tensioning actuator 204 were to fall below the tensioning pressure, the pulldown circuit check valve 280 would open to direct inflowing hydraulic fluid to the rod end chamber 214*b* and return the hydraulic pressure therein to the tensioning pressure. If the hydraulic pressure in the rod end chamber 214*b* were to exceed the tensioning pressure established by the inflowing hydraulic fluid, the pulldown circuit check valve 280 would prevent hydraulic fluid flowing back upstream towards the hoist actuator supply circuit 262 and pressure reducing valve 260 and maintain the rod end chamber 214*b* of the pulldown tensioning actuator 204 at the elevated hydraulic pressure.

INDUSTRIAL APPLICABILITY

Figure 3:
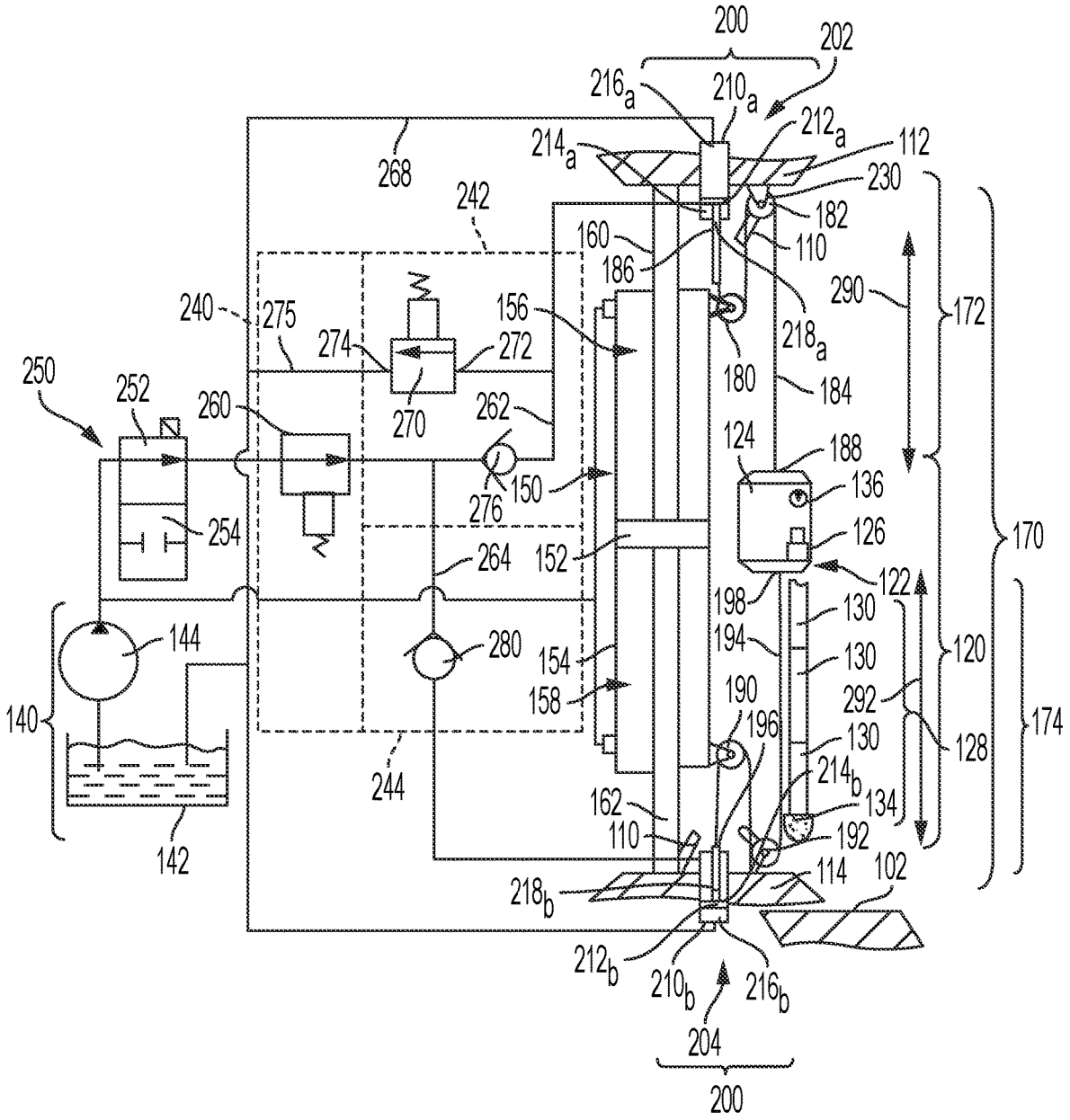
FIG. 3 is a schematic illustration of the tensioning hydraulic system including a hoist tensioning actuator and a pulldown tensioning actuator to maintain tension on the wire rope feed system during a pulldown operation.
Figure 4:
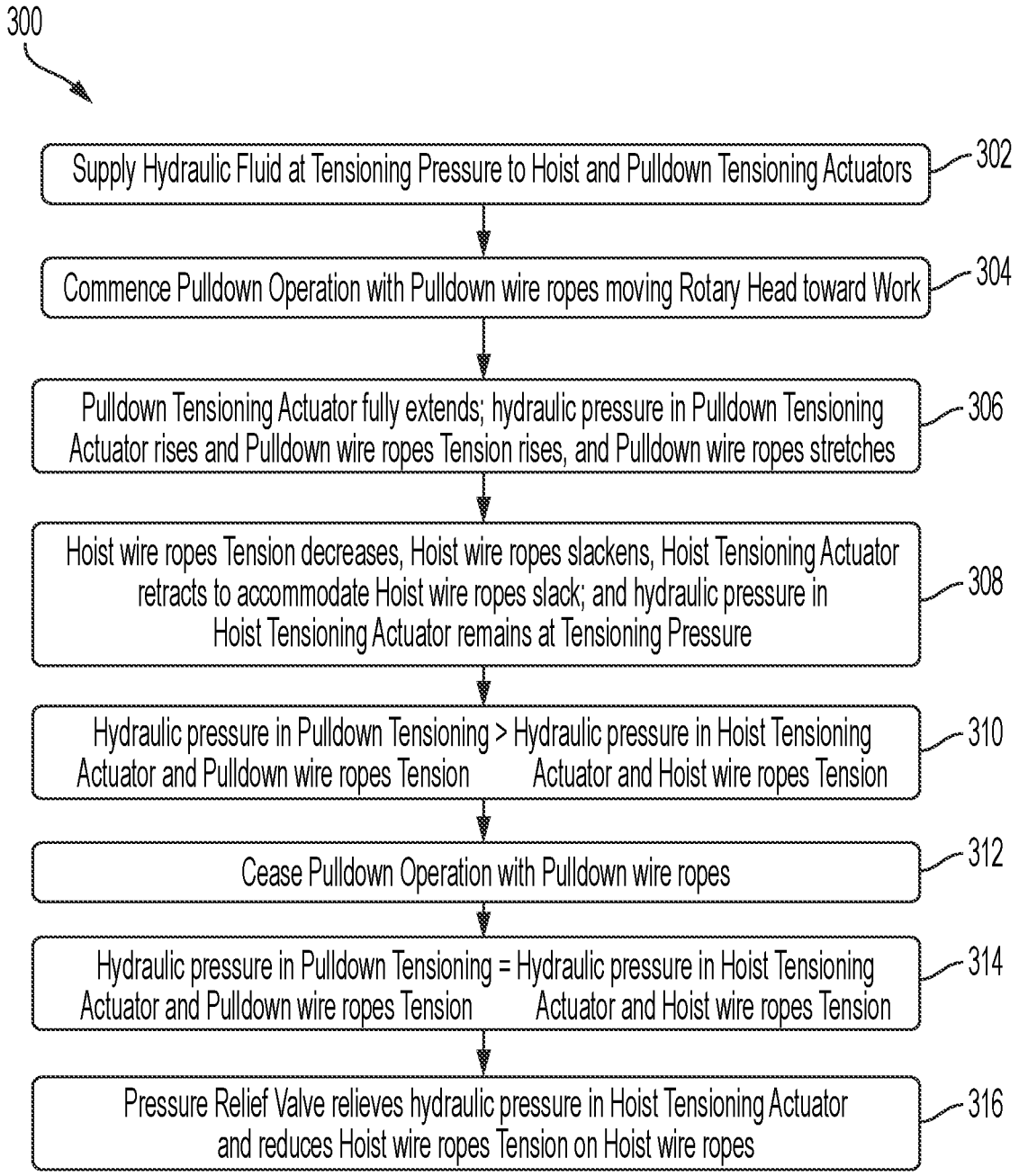
FIG. 4 is a schematic representation of a flow diagram illustrating a possible sequence of actions that may be conducted to maintain tension on the hoist and/or pulldown wire rope of the wire rope feed system.

Referring to FIGS. 3 and 4, there is illustrated the actions and effects of the tensioning system 200 in cooperation with the tensioning hydraulic circuit 240 during a pulldown operation conducted by the drilling system 120. Hydraulic fluid from the hydraulic reservoir 142 is pressurized by the hydraulic pump 144 and delivered to the tensioning hydraulic circuit 240. The pressure reducing valve 260 can reduce the hydraulic pressure of the inflowing hydraulic fluid to a tensioning pressure that the hoist tensioning actuator 202 and the pulldown tensioning actuator 204 of the tensioning system 200 can utilize. Downstream of the pressure reducing valve 260, the inflowing hydraulic fluid at the tensioning pressure is directed to the rod end chambers 214*a*, 214*b* of the hoist tensioning actuator 202 and of the pulldown tensioning actuator 204 by the hoist actuator supply conduit 262 and the pulldown actuator supply conduit 264 respectively. In the flow diagram of FIG. 4, this is represented in supplying step 302 in which hydraulic fluid at tensioning pressure is supplied to the hoist and pulldown tensioning actuators 202, 204.

When the rod end chambers 214*a*, 214*b* of the hoist and pulldown tensioning actuators 202, 204 both receive inflowing hydraulic fluid at the tensioning pressure, the tensioning pressure will tend to displace the hydraulic piston 212*a*,212*b* toward the piston end chamber 216*a*, 216*b* and retract the hydraulic piston rod 218*a*, 218*b* into the hydraulic cylinder body 210*a*, 210*b*. Retraction of the hydraulic piston rod 218*a*, 218*b* into the respective hoist and pulldown tensioning actuators 202, 204 places the hoist wire rope 184 and pulldown wire rope 194 in tension, which may be referred to as hoist rope tension 290 and pulldown rope tension 292 respectively. The hoist rope tension 290 and pulldown rope tension 292 are represented by arrows in FIG. 3. Prior to contact between the drill string 128 and the work surface 102, the hydraulic pressure in the rod end chambers 214*a*, 214*b* of the hoist and pulldown actuators 202, 204 and thus the hoist rope tension 290 and pulldown rope tension 292 are generally equal.

The pulldown operation commences, as indicated in commence pulldown step 304, by introducing pressurized hydraulic fluid to the hydraulic feed actuator 150 to move the feed cylinder 154 vertically upwards with respect to the mast 110. Correspondingly, the block and tackle configuration provided by the pulldown cylinder pulley 190, mast pulldown pulley 192, and pulldown wire rope 194 moves the rotary head 122 vertically downwards toward the work surface 102. When the drill bit 134 coupled to the rotary head 122 contacts the work surface 102, the counterforce transmitted through the drill string 128 to the rotary head 122 adds to the pulldown rope tension 292 on the pulldown wire rope 194. The hydraulic pressure in the pulldown tensioning actuator 204 rises above the tensioning pressure because hydraulic fluid is trapped in the rod end chamber 214*b* by the pulldown circuit check valve 280 in the pulldown hydraulic circuit 244. Further vertically downward movement of the rotary head 122 will increase the pulldown rope tension 292 and consequentially the pulldown wire rope 194 will stretch because the hydraulic piston rod 218*b* of the pulldown tensioning actuator 204 cannot extend further. This is represented by the pulldown rope stretch step 306 of FIG. 4.

The hoist rope tension 290 of the hoist wire rope 184, in contrast, may decrease because the vertically upward movement of the cylinder hoist pulley 180 in unison with the feed cylinder 154 allows the hoist wire rope 184 to be pulled downward with the rotary head 122. The reduction in hoist rope tension 290 causes the hoist wire rope 184 to slacken. To prevent the slackening hoist wire rope 184 from dislodging from the cylinder hoist pulley 180 and the mast hoist pulley 182, the tensioning pressure exerted by the hydraulic fluid in rod end chamber 214 of the hoist tensioning actuator 202 displaces the hydraulic piston 212*a* toward the piston end chamber 216*a* and causes the hydraulic piston rod 218*a* to retract into the hydraulic cylinder body 210*a*. Formation of slack in the hoist wire rope 184 is therefore prevented. Further, the hydraulic pressure in the rod end chamber 214*a* of the hoist tensioning actuator 202 remains at the tensioning pressure as set by the pressure reducing valve 260 upstream of the hoist actuator supply conduit 262. This is represented by the hoist rope slack reduction step 308 of the FIG. 6.

As represented by comparison block 310, in this situation, the hydraulic pressure in the pulldown tensioning actuator 204 and the pulldown rope tension 292 may be equal to or greater than the hydraulic pressure in the hoist tensioning actuator 202, which may be the tensioning pressure set by the pressure reducing valve 260, and the hoist rope tension 290.

In a cease pulldown operation step 312, the pulldown operation of the drilling system 120 is halted, for example, as may occur prior to initiating a hoist operation. Hydraulic fluid is no longer directed to the hydraulic feed actuator 150 and the rotary head 122 consequentially no longer moves vertically downward into the work surface 102. When the pulldown operation stops, the tensioning stresses imparted to the tensioning system 200 substantially change.

For example, because the feed cylinder 154 of the hydraulic feed actuator 150 no longer moves vertically upward with respect to the mast 110, the hoist wire rope 184 connected at the second hoist rope end 188 to the rotary head 122 may no longer freely follow the movement of the rotary head. The hoist wire rope 184 may, as a result, become taut and the hoist rope tension 290 may increase. The increase in hoist rope tension 290 may cause the hoist wire rope 184 to pull the hydraulic piston rod 218 in the hydraulic cylinder body 210*a* toward the rod end chamber 214*a*. The hydraulic piston 212*a* likewise moves toward the rod end chamber 216*a* compressing the hydraulic fluid therein and thereby increases the hydraulic pressure in the hoist tensioning actuator 202. In this situation, as indicated by comparison block 314, the hydraulic pressure in the hoist tensioning actuator 202 and the hoist rope tension 290 may approach or be approximately equal to the hydraulic pressure in the pulldown tensioning actuator 204 and the pulldown rope tension 292, respectively. Moreover, the hydraulic pressure in the hoist and pulldown tensioning actuators 202, 204 may be equal to or greater than the tensioning pressure set by the pressure reducing valve 260 of the tensioning hydraulic circuit 240.

To reduce the hoist rope tension 290, the pressure relief valve 270 of the hoist hydraulic circuit 262 may open to discharge or divert inflowing hydraulic fluid in the hoist actuator supply conduit 264 from the hoist tensioning actuator 202. For example, if the predetermined threshold pressure of the pressure relief valve 270 is set for the relief pressure threshold, the rise in the hydraulic pressure of the hoist tensioning cylinder 202 above the relief pressure threshold will cause the pressure relief valve 270 to open. A part of the hydraulic fluid in the hoist hydraulic circuit 242 at the tensioning pressure set by the pressure reducing valve 260 is diverted by the pressure relief valve 270 to the hydraulic reservoir 142. Moreover, the hydraulic pressure in the rod end chamber 214*a* of the hoist tensioning actuator 202, which is fluidly connected to the pressure relief valve 270 by the hoist actuator supply conduit 262, is reduced and may establish equilibrium with the tensioning pressure. Consequentially, the hydraulic piston 212*a* can displace into the rod end chamber 214*a* and the hydraulic piston rod 218*a* can extend from the hoist tensioning actuator 202 to reduce the hoist rope tension 290 until the hydraulic piston 212*a* abuts the hydraulic cylinder 210*a* and the hydraulic piston rod 218*a* is fully extended. This is represented by the pressure relief step 316 in FIG. 4.

Accordingly, the disclosure provides a tensioning hydraulic circuit 240 that operates in cooperation with a tensioning system 200 operatively associated with wire rope feed system 170 of the drilling system 120. The tensioning hydraulic circuit 240 is operatively separated into a hoist hydraulic circuit 242 operatively associated with a hoist tensioning actuator 202 and a pulldown hydraulic circuit 244 operatively associated with the pulldown tensioning actuator 204. The hoist hydraulic circuit 242 includes a pressure limiting feature in the form of a pressure relief valve 270 in fluid communication with a hoist actuator supply conduit 262 to the hoist tensioning actuator 202 and with a hoist actuator return conduit 268 in fluid communication with the hydraulic reservoir 142. The pulldown hydraulic circuit 244 includes a pressure isolation feature in the form of a pulldown circuit check valve 280 disposed in the pulldown actuator supply conduit 264 that allows hydraulic fluid to flow to the pulldown tensioning actuator 204 and prevents hydraulic flow back upstream from the pulldown tensioning actuator 204.

In a pulldown operation, the pulldown rope tension 292 may rise as the drilling system 120 penetrates the work surface 102. Consequentially, the hydraulic piston rod 218*b* extends from the pulldown tensioning actuator 204 and the hydraulic pressure therein rises above the tensioning pressure established by the pressure reducing valve 260 and is maintained at the heightened pressure by the pulldown circuit check valve 280. During a pulldown operation, the increased pulldown rope tension 292 may assist the drill string 128 of the drilling system 120 in penetrating the work surface 102, but may also result in stretching of the pulldown wire rope 194.

When the pulldown wire rope 194 stretches, the hoist rope tension 290 may be reduced and the hoist wire rope 184 may go slack. To reduce the slack in the hoist wire rope 184, the hydraulic piston rod 218*a* of the hoist tensioning actuator 202 may be retracted due to the hydraulic fluid therein that maintains the hoist tensioning actuator 202 at the tensioning pressure. If the pulldown operation ceases, for example, prior to initiating a hoist operation or the drilling system encounters a hard rock formation, the hoist rope tension 290 may rise as the hoist rope tension 290 and the pulldown rope tension 290 equalize and the hydraulic pressure in the hoist tensioning actuator 202 may consequentially increase. The pressure relief valve 270 may open draining the hydraulic fluid in the hoist actuator supply conduit 262 to the hydraulic reservoir 142 bypasses the hoist tensioning actuator 202 and thereby lowers the hydraulic pressure in the hoist tensioning actuator 202.

In an embodiment, to ensure the hoist tensioning actuator 202 quickly and dynamically responds to any changes in hydraulic pressure therein, the hoist actuator supply conduit 262 and the hoist actuator return conduit 268 may be larger than the pulldown actuator supply conduit 264 and pulldown actuator return conduit 278. Accordingly hydraulic fluid at tensioning pressure can be quickly directed to the hoist tensioning actuator 202 to remove slack developing in the hoist wire rope 184. Likewise, hydraulic fluid can be quickly directed from the hoist tensioning actuator 202 to reduce a spike in hydraulic pressure therein. The hoist tensioning actuator 202 therefore can therefore compensate for temporary stretching and elastic elongation that may to the hoist and pulldown wire ropes 184, 194 as the drilling system 120 alternates between pulldown operation and hoist operations.

The pulldown tensioning actuator 204 and pulldown hydraulic circuit 242, in contrast, may respond more gradually to changes in the operation of the drilling system 120. For example, the pulldown tensioning actuator 204 can be arranged to compensate for permanent stretching and elongation of the hoist and pulldown wire ropes 184, 194 that may occur over time and from which the wire ropes may not recover.

In an embodiment, the drilling system 120 can commence a hoist operation in which the tensioning stresses applied to the wire rope feed system 170 are substantially converse to the pulldown operation. For example, during the hoist operation, the hoist rope tension 290 is increased as the feed cylinder 154 of the hydraulic feed actuator 150 moves vertically downward, for example, by directing hydraulic fluid to the lower chamber 158. The corresponding downward movement of the cylinder hoist pulley 180 attached to the feed cylinder causes the hoist wire rope 184 to move the rotary head 122 vertically upwards with respect to the work surface 102. The increase in the hoist rope tension 290 causes the hydraulic pressure in the hoist tensioning actuator 202 to increase as the hydraulic piston 212*a* is displaced into the rod end chamber 214*a* and the hydraulic piston rod 218*a* extends from the hoist tensioning actuator 202. The hydraulic piston 212*a* may abut the hydraulic cylinder body 210*a* so the hydraulic piston rod 218*a* is fully extended. Further increase in the hoist rope tension 290 may result in stretching of the hoist wire rope 184.

Conversely, the pulldown rope tension 292 may be reduced because the pulldown wire rope 194 readily moves upwards with the rotary head 122 to which it is attached. The reduction in the pulldown rope tension 292 may result in the pulldown wire rope 194 slackening and may simultaneously reduce the hydraulic pressure in the pulldown tensioning actuator 204. However, the rod end chamber 214*a* of the pulldown tensioning actuator 204 remains in fluid communication with the pressure reducing valve 260 via the pulldown actuator supply conduit 264 and the pulldown circuit check valve 280 and can continue to receive hydraulic fluid at the tensioning pressure. The hydraulic fluid at tensioning pressure in the rod end chamber 214*a* of the pulldown tensioning actuator 204 displaces the hydraulic piston 212*a* toward the piston end chamber 216*a* and retracts the hydraulic piston rod 218*a* into the hydraulic cylinder body 210*a*, thereby applying at least the tensioning pressure to the pulldown wire rope 194 and reducing or eliminating slack therein.

In an embodiment, when the hoist operation is generating substantial tension in the hoist wire rope 184 as a result of the substantially high hydraulic pressure in the lower chamber 148 of the hydraulic feed actuator 150, the tensioning hydraulic circuit 220 can act to limit hydraulic pressure in the pulldown tensioning actuator 204 and limit the tensioning force applied to the pulldown wire rope 194. For example, because hydraulic fluid in the rod end chamber 214*b* of the pulldown tensioning actuator 204 is isolated or trapped by the pulldown circuit check valve 280, the hydraulic pressure therein may exceed the tensioning pressure established by the pressure reducing valve 260. As the hydraulic pressure in the hydraulic feed actuator 150 continues to rise and the slack in the pulldown wire rope 194 correspondingly increases, the tensioning hydraulic circuit 220 will direct additional hydraulic fluid to the pulldown tensioning actuator 204 to compensate for the slack. Accordingly, there may be an excessive quantity of hydraulic fluid in the pulldown tensioning actuator 204 resulting in excessive hydraulic pressure therein when the hoist operation ceases. The control valve 250 can be configured in the closed position 254 preventing hydraulic fluid from flowing to the tensioning hydraulic circuit 220 and thus onto the pulldown tensioning actuator 204 thereby limiting the hydraulic pressure present and isolated in the pulldown tensioning actuator. For example, the control valve 250 may configure itself in the closed position 254 if the hydraulic pressure in the hydraulic feed actuator 150 exceeds a predetermined hoisting pressure limit. The hoisting pressure limit associated with the hydraulic feed actuator 150 may be set to prevent the flow of hydraulic fluid to the pulldown tensioning actuator 204 based on the hydraulic pressure in the hydraulic feed actuator during hoisting operations. Because the hydraulic pressure in the pulldown tensioning actuator 204 is limited under these circumstances, the pulldown tensioning actuator will not apply or result in an excessive pulldown rope tension 292 when the hoist operation ceases. Instead, the hoist rope tension 290 in the hoist wire rope 184 and the pulldown rope tension 292 in the pulldown wire rope 194 can redistribute and may equalize, thereby avoiding excessive tension or stress on the hoist and pulldown wire ropes.

An advantage of the foregoing is that disclosed tensioning hydraulic circuit 240 can reduce or eliminate the slackening of the hoist and/or pulldown wire ropes wire rope feed system by utilizing and manipulating the hydraulic pressure in the hoist and pulldown tensioning actuators to reduce the tension applied, or avoid prolonged application of tension, to the hoist and pulldown wire ropes. Operating the hoist and pulldown wire ropes at lower tension prolongs the operational life of the wire rope feed system and reduces operating cost of the drilling rig. These and other advantages and features of the disclosure should be apparent from the foregoing description and accompanying drawings.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure and the protection to which applicant is entitled more generally. All language of distinction and disparagement with respect to certain features is intended to indicate a lack of preference for those features, but not to exclude such from the scope of the disclosure entirely unless otherwise indicated.

We claim:

1. A mobile rotary drilling rig comprising:

a rig frame supported on a plurality of propulsion devices for propelling the mobile rotary drilling rig over a work surface;

a mast mounted to the rig frame;

a rotary head movably supported along the mast and operatively coupled to and adapted to rotate a drilling string with respect to the work surface;

a hydraulic feed actuator movable with respect to the mast;

a wire rope feed system operatively connecting the rotary head with the hydraulic feed actuator, the wire rope feed system including:

a hoist wire rope operatively interacting with a hoist tensioning actuator and connected at a second hoist rope end to the rotary head; and a pulldown wire rope operatively interacting with a pulldown tensioning actuator and connected at a second pulldown rope end to the rotary head; and a tensioning hydraulic circuit configured to direct hydraulic fluid at a tensioning pressure to the hoist tensioning actuator and to the pulldown tensioning actuator, the tensioning hydraulic circuit including a hoist hydraulic circuit operatively associated with the hoist tensioning actuator and having a hoist actuator supply conduit and a hoist actuator return conduit both in fluid communication with the hoist tensioning actuator, the hoist hydraulic circuit further having a pressure relief valve in fluid communication with the hoist actuator supply conduit and the hoist actuator return conduit to bypass the hoist tensioning actuator to relieve hydraulic pressure therein.

2. The mobile rotary drilling rig of claim 1, wherein the pressure relief valve is normally closed and is set to open at a relief pressure threshold.

3. The mobile rotary drilling rig of claim 2, wherein the pressure relief valve limits hydraulic pressure in the hoist tensioning actuator to the relief pressure threshold.

4. The mobile rotary drilling rig of claim 3, wherein the relief pressure threshold is within a range between being equal to the tensioning pressure and equal to or within six times the tensioning pressure.

5. The mobile rotary drilling rig of claim 4, wherein the hoist actuator supply conduit fluidly communicates with a rod end chamber of the hoist tensioning actuator and the hoist actuator return conduit fluidly communicates with a piston end chamber of the hoist tensioning actuator.

6. The mobile rotary drilling rig of claim 1, wherein the tensioning hydraulic circuit includes a pulldown hydraulic circuit operatively associated with the pulldown tensioning actuator and having a pulldown circuit check valve to isolate hydraulic fluid therein.

7. The mobile rotary drilling rig of claim 6, wherein the pulldown circuit check valve maintains hydraulic pressure in the pulldown tensioning actuator at or above the tensioning pressure.

8. The mobile rotary drilling rig of claim 7, wherein the pulldown hydraulic circuit includes a pulldown actuator supply conduit and a pulldown actuator return conduit both in fluid communication with the pulldown tensioning actuator, the pulldown circuit check valve disposed in the pulldown actuator supply conduit.

9. The mobile rotary drilling rig of claim 8, wherein the pulldown actuator supply conduit fluidly communicates with a rod end chamber of the pulldown tensioning actuator and the pulldown actuator return conduit fluidly communicates with a piston end chamber of the pulldown tensioning actuator.

10. The mobile rotary drilling rig of claim 6 wherein the tensioning hydraulic circuit includes a pressure reducing valve in fluid communication with the hoist hydraulic circuit and with the pulldown hydraulic circuit, the pressure reducing valve configured to reduce pressure of hydraulic fluid inflowing to the tensioning hydraulic circuit to the tensioning pressure.

11. The mobile rotary drilling rig of claim 6, wherein the tensioning hydraulic circuit includes a control valve to limit flow of hydraulic fluid to the pulldown tensioning actuator if hydraulic pressure in the hydraulic feed actuator exceeds a feed hoisting pressure limit.

12. The mobile rotary drilling rig of claim 6, wherein the hoist hydraulic circuit includes a hoist circuit check valve to prevent flow of hydraulic fluid from the hoist tensioning actuator to the pulldown hydraulic circuit.

13. The mobile rotary drilling rig of claim 1, wherein:

the hoist wire rope is disposed about a cylinder hoist pulley on the hydraulic feed actuator and disposed about a mast hoist pulley fixed to the mast; and the pulldown wire rope is disposed about a cylinder pulldown pulley on the hydraulic feed actuator and disposed about a mast pulldown pulley fixed to the mast.

14. A method of tensioning a wire rope feed system of a drilling rig having a drilling system, the method comprising:

directing hydraulic fluid at a tensioning pressure to a hoist tensioning actuator operatively associated with a hoist wire rope, a second hoist rope end of the hoist wire rope connected to a rotary head of the drilling system;

directing hydraulic fluid at the tensioning pressure to a pulldown tensioning actuator operatively associated with a pulldown wire rope, a second pulldown rope end of the pulldown wire rope connected to the rotary head of the drilling system;

commencing a pulldown operation by moving the rotary head toward a work surface with the pulldown wire rope resulting in stretching of the pulldown wire rope and slackening of the hoist wire rope;

reducing slack of the hoist wire rope by retracting the hoist tensioning actuator operatively associated with the the hoist wire rope;

ceasing the pulldown operation resulting in hydraulic pressure in the hoist tensioning actuator exceeding a relief pressure threshold; and relieving hydraulic pressure in the hoist tensioning actuator by opening a pressure relief valve in fluid communication with the hoist tensioning actuator.

15. The method of claim 14, wherein the relief pressure threshold is within a range between being equal to the tensioning pressure and equal to or within six times the tensioning pressure.

16. The method of claim 14, further comprising maintaining hydraulic pressure in the pulldown tensioning actuator at or above the tensioning pressure with a pulldown circuit check valve.

17. The method of claim 14, further comprising preventing flow of hydraulic fluid from the hoist tensioning actuator to the pulldown tensioning actuator with a hoist circuit check valve disposed in fluid communication between the hoist tensioning actuator and the pulldown tensioning actuator.

18. The method of claim 14, further comprising conducting a hoist operation by moving the rotary head away from the work surface with the hoist wire rope resulting in stretching of the hoist wire rope and slackening of the pulldown wire rope and reducing slack of the pulldown wire rope by retracting the pulldown tensioning actuator connected the first pulldown rope end of the pulldown wire rope.

19. The method of claim 18, further comprising limiting flow of hydraulic fluid to the pulldown tensioning actuator with a control valve if hydraulic pressure in a hydraulic feed actuator operatively associated with and moving the rotary head exceeds a hoisting pressure limit associated with the hydraulic feed actuator.

20. A rotary drilling rig comprising:

a rig frame;

a mast mounted to the rig frame;

a rotary head movably supported along the mast and operatively coupled to and adapted to rotate a drilling string with respect to the work surface;

a hydraulic feed actuator movable with respect to the mast;

a wire rope feed system operatively connecting the rotary head with the hydraulic feed actuator, the rope feed system including:

a hoist wire rope operatively associated with a hoist tensioning actuator and connected at a second hoist rope end to the rotary head; and a pulldown wire rope operatively associated with a pulldown tensioning actuator and connected at a second pulldown rope end to the rotary head; and a tensioning hydraulic circuit configured to direct hydraulic fluid to the hoist tensioning actuator and to the pulldown tensioning actuator, the tensioning hydraulic circuit including:

a hoist hydraulic circuit operatively associated with the hoist tensioning actuator and including a pressure relief feature configured to relieve hydraulic pressure in the hoist tensioning actuator in excess of a relief pressure threshold;

a pulldown hydraulic circuit including a pressure isolation feature configured to isolate hydraulic pressure in the pulldown tensioning actuator;

wherein the hoist hydraulic circuit further includes a hoist circuit check valve to prevent flow of hydraulic fluid from the hoist tensioning actuator to the pulldown hydraulic circuit and the pulldown hydraulic circuit further includes a pulldown circuit check valve disposed in a pulldown actuator supply conduit arranged to direct fluid to the pulldown tensioning actuator.

21. The rotary drilling rig of claim 20, wherein the pressure relief feature includes pressure relief valve in fluid communication with a hoist actuator supply conduit arranged to direct hydraulic fluid at the tensioning pressure to the hoist tensioning actuator.

* * * * *